US005266924A

United States Patent [19]

Chung

[11] Patent Number: 5,266,924

[45] Date of Patent: Nov. 30, 1993

[54] SHOCK AND VIBRATION DETECTING DEVICE

[76] Inventor: Charles Chung, 3F, No. 130, Yungchi Road, Taipei, Taiwan

[21] Appl. No.: 813,909

[22] Filed: Dec. 23, 1991

[51] Int. Cl.[5] ..... G08B 21/00; G08B 13/02

[52] U.S. Cl. ..... 340/566; 73/650; 307/117; 340/429; 340/683

[58] Field of Search ..... 340/566, 683, 429; 73/650; 307/117

[56] References Cited

U.S. PATENT DOCUMENTS 4,001,771 1/1977 Amrine et al. ..... 340/566

4,864,288 9/1989 Cross ..... 340/566

*Primary Examiner*—Glen R. Swann, III

*Attorney, Agent, or Firm*—Poms, Smith, Lande & Rose

[57] ABSTRACT

A shock and vibration detecting device comprising a sensor enclosed in an electromagnetic shielded and dust-proof case to send out a signal to an amplifying circuit constituted mainly by an operational amplifier once it picks up a shock and/or vibration signal. The output of the amplifying circuit is connected to a driving circuit to provide an output signal. A delaying circuit is used to lengthen the active period of the output signal. A voltage regulation circuit provides a regulated and filtered voltage to the above-mentioned circuits.

3 Claims, 3 Drawing Sheets

SHOCK AND VIBRATION DETECTING DEVICE

FIELD OF THE INVENTION

The present invention relates generally to a shock and vibration detecting device and in particular to one used to pick up slight vibration of objects.

BACKGROUND OF THE INVENTION

Burglary usually happens extremely often in the urban area of large cities. Precaution perhaps is the best way to cut off the loss of burglary. Nevertheless, the currently commercial burglar-proof devices available in the market are not very effective because of high possibility of abnormal actuation caused by poor electrical reliability of the device or external noise.

OBJECTS OF THE INVENTION

It is therefore an object of the present invention to provide a shock and vibration detecting device which can be mounted on any object to be monitored and once the object is vibrated, a warning signal is sent out.

It is another object of the present invention to provide a shock and vibration detecting device which can be used as a burglar-proof device or a detector for audio signal.

It is a further object of the present invention to provide a shock and vibration detecting device of which the sensitivity is adjustable in order to filter out unwanted frequency and noise.

It is a further object of the present invention to provide a shock and vibration detecting device which has no such disadvantage of mechanic fatigue as the conventional mechanical vibration detecting devices have and can keep operative and active for a very long time.

To achieve the above-mentioned objects, there is provided a shock and vibration detecting device which comprises a sensor enclosed in an electromagnetic shielded and dust-proof case to send out a signal to an amplifying circuit constituted mainly by an operational amplifier once it picks up a shock and/or vibration signal. The output of the amplifying circuit is connected to a driving circuit to provide an output signal. A delaying circuit is used to lengthen the active period of the output signal. A voltage regulation circuit provides a regulated and filtered voltage to the above-mentioned circuits.

Other objects and advantages of the invention will be apparent from the following description of the preferred embodiment taken in connection with the accompanying drawings wherein:

DETAILED DESCRIPTION OF THE PREFERRED EMBODIMENT

Figure 1:
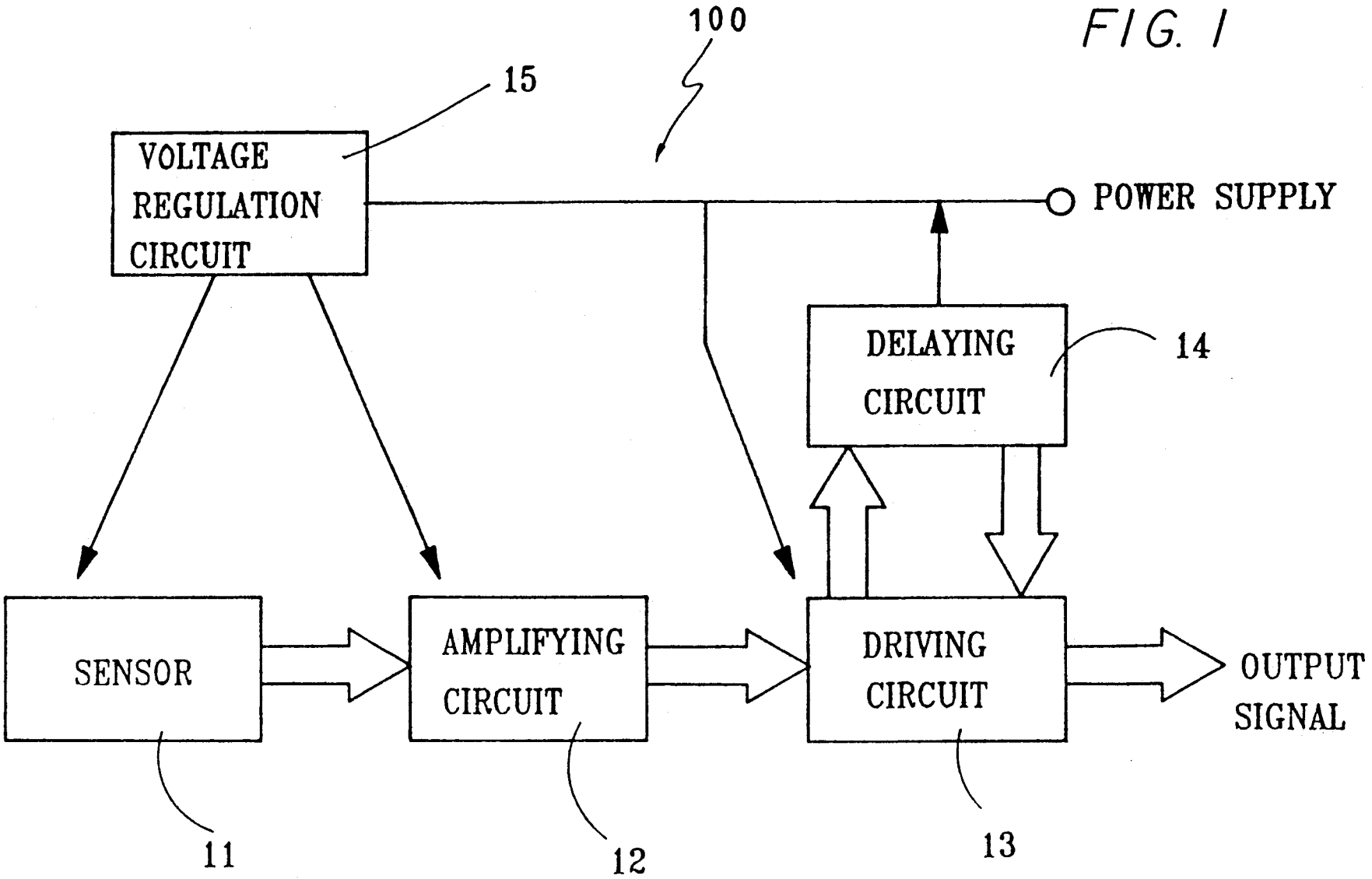
FIG. 1 is a block diagram of the present invention.

With reference to the drawings and in particular to FIG. 1, a shock and vibration detecting device in accordance with the present invention, generally designated with the reference numeral 100, comprises a sensor 11, an amplifying circuit 12, a driving circuit 13, a delaying circuit 14, and a voltage regulation circuit 15. The sensor 11 which picks up vibrations occurs on the monitored object (not shown) sends out a signal resulted from the vibration to the amplifying circuit 12. The signal is then transferred to the driving circuit 13 to produce an output signal after being amplified by the amplifying circuit 12. The delaying circuit 14 is used to lengthen the active period of the output signal produced by the driving circuit 13. The voltage regulation circuit 15 supplies a regulated and filtered voltage to the above-mentioned circuits.

Figure 3:
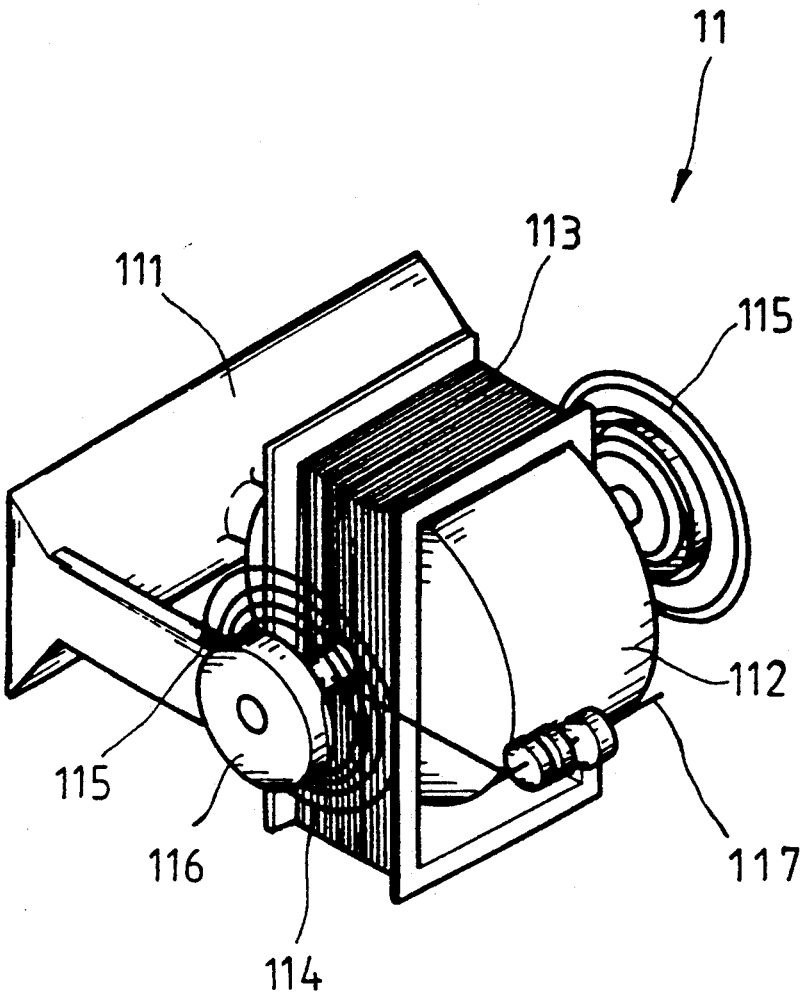
FIG. 3 is a perspective view showing the sensor of the present invention used to pick up vibrations.

With reference in particular to FIG. 3, the sensor 11, which is enclosed inside an electromagnetic shielded and dust-proof case (not shown), comprises a base 111, on which two supports 116 are fixed with a space preserved therebetween to receive an induction coil 113 therein. The induction coil 113 is pivotally supported and secured between the supports 116 with a securing axle 114. Two spring wires 115 are attached to the securing axle 114 such that pivoting of the induction coil 113 affixed to the securing axle 114 deforms the spring wires 115. A vibration arm 117 which serves as an indicator is extended from the induction coil 113 to be in balance with the spring wires 115 so that when a shock or vibration happens, the balance is broken and a signal is induced in the induction coil 113.

Figure 2:
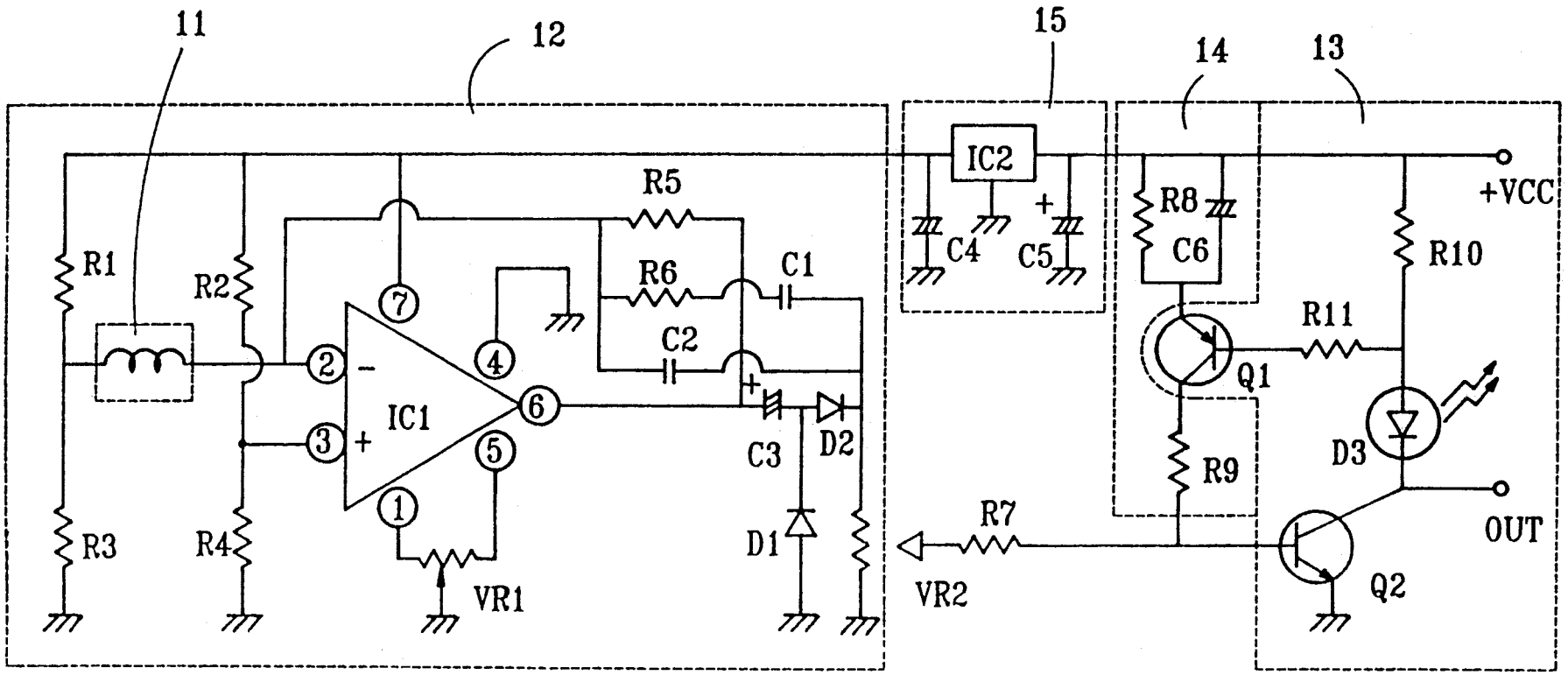
FIG. 2 shows the circuit of the present invention.

With reference to FIG. 2, the amplifying circuit 12 is constituted mainly by an operational amplifier $IC_1$ of which terminals 4 and 7 are power terminals and are respectively grounded and connected to the voltage regulation circuit 15. Terminals 2 and 3 of the operational amplifier $IC_1$ are input terminals of which the input voltages are determined by two series of resistors $R_1$, $R_3$ and $R_2$, $R_4$, all of the same impedance. The first series which is constituted by the resistors $R_1$ and $R_3$ is connected to the inverting input terminal 2 of the operational amplifier $IC_1$ with the sensor 11 therebetween and the second series which is constituted by the resistors $R_2$ and $R_4$ is connected to the non-inverting input terminal 3 of the operational amplifier $IC_1$. Since all the four resistors, $R_1$, $R_2$, $R_3$, and $R_4$, are of the same impedance, when the sensor 11 sends out nothing, there is no difference between the input voltages to the terminals 2 and 3, and when the sensor 11 sends out a signal, the voltage balance between the terminals 2 and 3 is broken and an amplified output signal is produced in terminal 6, the output terminal, of the operational amplifier $IC_1$. A variable resistor $VR_1$ is connected between terminals 1 and 5 of $IC_1$ to adjust the output voltage to half of the input voltage of $IC_1$ when no input signal is present in order to provide better non-cutoff AC signals. The output of the operational amplifier $IC_1$ is connected to a variable resistor $VR_2$ via a capacitor $C_3$. With the variable resistor $VR_2$, the output of the amplifying circuit 12 is adjustable. A diode $D_2$ is connected between the variable resistor $VR_2$ and the capacitor $C_3$ in series while another diode $D_1$ is connected to the capacitor $C_3$ in parallel with the variable resistor $VR_2$ to rectify the output signal.

A resistor $R_5$ is connected between the output terminal 6 and the inverting input terminal 2 to provide a feedback to the operational amplifier $IC_1$ to prevent the output voltage of the operational amplifier $IC_1$ from drifting. A capacitor $C_2$ is connected between the variable resistor $VR_2$ and the inverting input terminal 2 of the operational amplifier $IC_1$ to provide a high frequency feedback to filter noise of frequency higher than the normal audio frequency. Also connected between the variable resistor $VR_2$ and the inverting input terminal 2 of the operational amplifier $IC_1$ is a series of a resistor $R_6$ and a capacitor $C_1$ to adjust the frequency response of the sensor 11 so as to generally maintain the gain thereof constant.

The output of the amplifying circuit 12, which is positive impulses, is sent to a transistor $Q_2$ via a resistor $R_7$ to make $Q_2$ a switch and the status of the transistor $Q_2$ is indicated by an LED (light emitting diode) $D_3$. A resistor $R_{10}$ is connected in series between the LED $D_3$ and a power source of voltage $+V_{cc}$ to limit the current flowing through the LED $D_3$. The voltage of the connection between $R_{10}$ and $D_3$ is connected to a transistor $Q_1$ via a limiting resistor $R_{11}$ to serve as a reference voltage for biasing the transistor $Q_1$. A resistor $R_9$ is connected between the output of the transistor $Q_1$ and the base of the transistor $Q_2$.

A resistor $R_8$ and a capacitor $C_5$ are connected in parallel to define a time constant and are connected between the power source of $V_{cc}$ and the transistor $Q_1$. When a triggering signal is sent to the transistor $Q_1$, the transistor $Q_1$ goes on to charge the capacitor $C_6$ and current flows into the transistor $Q_1$ via the resistor $R_8$ and the capacitor $C_6$ and then to the transistor $Q_2$ via the resistor $R_9$. The resistor $R_7$ can be used to prevent the current flowing from the transistor $Q_1$ to the transistor $Q_2$ from flowing to ground via the variable resistor $VR_2$. The capacitor $C_6$ provides a biasing voltage to the transistor $Q_2$ to continue keeping it on after the signal sent out by the amplifying circuit 12 is ended so as to lengthen the active period of output signal produced by the driving circuit 13.

The power supply $V_{cc}$ of the system is connected to a grounded capacitor $C_5$ to provide a filtered voltage to the transistors $Q_1$ and $Q_2$. The power supply is also connected to a voltage regulation integrated circuit $IC_2$ to provide stable voltage to the operational amplifier $IC_1$. The voltage supplied to the operational amplifier $IC_1$ is also filtered by a grounded capacitor $C_4$ which is connected to an output terminal of the voltage regulation integrated circuit $IC_2$.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. A shock and vibration detecting device comprising an inductive motion sensor, an amplifying circuit, a driving circuit, a delaying circuit and a voltage regulation circuit of which the sensor is connected to an input of the amplifying circuit and an output of the amplifying circuit is connected to the driving circuit via a gain control means so that when the sensor picks up a vibration, an amplified signal is sent out by the amplifying circuit to produce an output signal having an active period determined by the delaying circuit via the driving circuit, the voltage regulation circuit being connected to the amplifying circuit and the driving circuit to provide a filtered and regulated voltage thereto, wherein said sensor comprises an electromagnetic shielded and dust-proof case containing therein a base, on which two supports are fixed with a space preserved therebetween to receive an induction coil therein, said induction coil being pivotally supported and secured between said supports with a securing axle, said sensor further comprising two spring wires which, with a first one end thereof fixed on said supports, are respectively attached to said securing axle on each side of said induction coil and a vibration arm which is extended from said induction coil to be in balance with said spring wires so that when a vibration happens, the balance is broken and a signal is induced in said induction coil.

2. A shock and vibration detecting device comprising an inductive motion sensor, an amplifying circuit, a driving circuit, a delaying circuit and a voltage regulation circuit of which the sensor is connected to an input of the amplifying circuit and an output of the amplifying circuit is connected to the driving circuit via a gain control means so that when the sensor picks up a vibration, an amplified signal is sent out by the amplifying circuit to produce an output signal having an active period determined by the delaying circuit via the driving circuit, the voltage regulation circuit being connected to the amplifying circuit and the driving circuit to provide a filtered and regulated voltage thereto, wherein said sensor includes a spring wire and an induction coil whereby movement of the induction coil creates an electrical signal and, wherein said movement of the induction coil consists of pivoting a vibration arm attached to said coil.

3. A shock and vibration detecting device comprising an inductive motion sensor, an amplifying circuit, a driving circuit, a delaying circuit and a voltage regulation circuit of which the sensor is connected to an input of the amplifying circuit and an output of the amplifying circuit is connected to the driving circuit via a gain control means so that when the sensor picks up a vibration, an amplified signal is sent out by the amplifying circuit to produce an output signal having an active period determined by the delaying circuit via the driving circuit, the voltage regulation circuit being connected to the amplifying circuit and the driving circuit to provide a filtered and regulated voltage thereto, wherein said sensor includes an induction coil, a pair of spring wires holding said induction coil in balance, and a securing axle about which said induction coil rotates.

* * * * *